US006997788B2

(12) United States Patent
Wu et al.

(10) Patent No.: US 6,997,788 B2
(45) Date of Patent: Feb. 14, 2006

(54) MULTI-TOOL, MULTI-SLURRY CHEMICAL MECHANICAL POLISHING

(75) Inventors: Kuo-Chun Wu, San Jose, CA (US); Richard Gan, Santa Clara, CA (US); Karen Wong, Milpitas, CA (US)

(73) Assignee: Mosel Vitelic, Inc., Hsin Chu (TW)

( * ) Notice: Subject to any disclaimer, the term of this patent is extended or adjusted under 35 U.S.C. 154(b) by 0 days.

(21) Appl. No.: 10/677,785

(22) Filed: Oct. 1, 2003

(65) Prior Publication Data

US 2005/0075056 A1 Apr. 7, 2005

(51) Int. Cl.
*B24B 1/00* (2006.01)

(52) U.S. Cl. ..... 451/57; 451/41; 451/66; 451/5

(58) Field of Classification Search ..... 451/6, 451/57, 66, 41, 5; 438/692–693; 700/164
See application file for complete search history.

(56) References Cited

U.S. PATENT DOCUMENTS 5,676,587 A * 10/1997 Landers et al. ..... 451/57
6,203,404 B1 * 3/2001 Joslyn et al. ..... 451/37
6,224,465 B1 * 5/2001 Meyer ..... 451/41
6,227,949 B1 * 5/2001 Yi et al. ..... 451/57
6,227,950 B1 * 5/2001 Hempel et al. ..... 451/66
6,338,667 B2 * 1/2002 Sandhu et al. ..... 451/5
6,431,959 B1 * 8/2002 Mikhaylich et al. ..... 451/41
6,594,542 B1 * 7/2003 Williams ..... 700/164
6,632,124 B2 * 10/2003 Adams et al. ..... 451/5
6,726,535 B2 * 4/2004 Shih et al. ..... 451/37
2002/0100743 A1 8/2002 Bonner et al.
2003/0036339 A1 2/2003 Bonner et al.

* cited by examiner

*Primary Examiner*—George Nguyen
(74) *Attorney, Agent, or Firm*—MacPherson Kwok Chen & Heid LLP; Gideon Gimlan

(57) ABSTRACT

A chemical mechanical polishing method is disclosed in which a batch of wafers is first supplied to a low-selectivity, first CMP tool for partly polishing the batch with one or more relatively non-selective CMP slurries (e.g., silica ($SiO_2$) based); and in which the batch of partly-polished wafers is subsequently transferred to a higher-selectivity, second CMP tool which uses one or more comparatively more-selective CMP slurries (e.g., ceria ($CeO_2$) based) to further the polishing of the batch of partly-polished wafers and/or to complete the polishing of the partly-polished wafers.

14 Claims, 2 Drawing Sheets

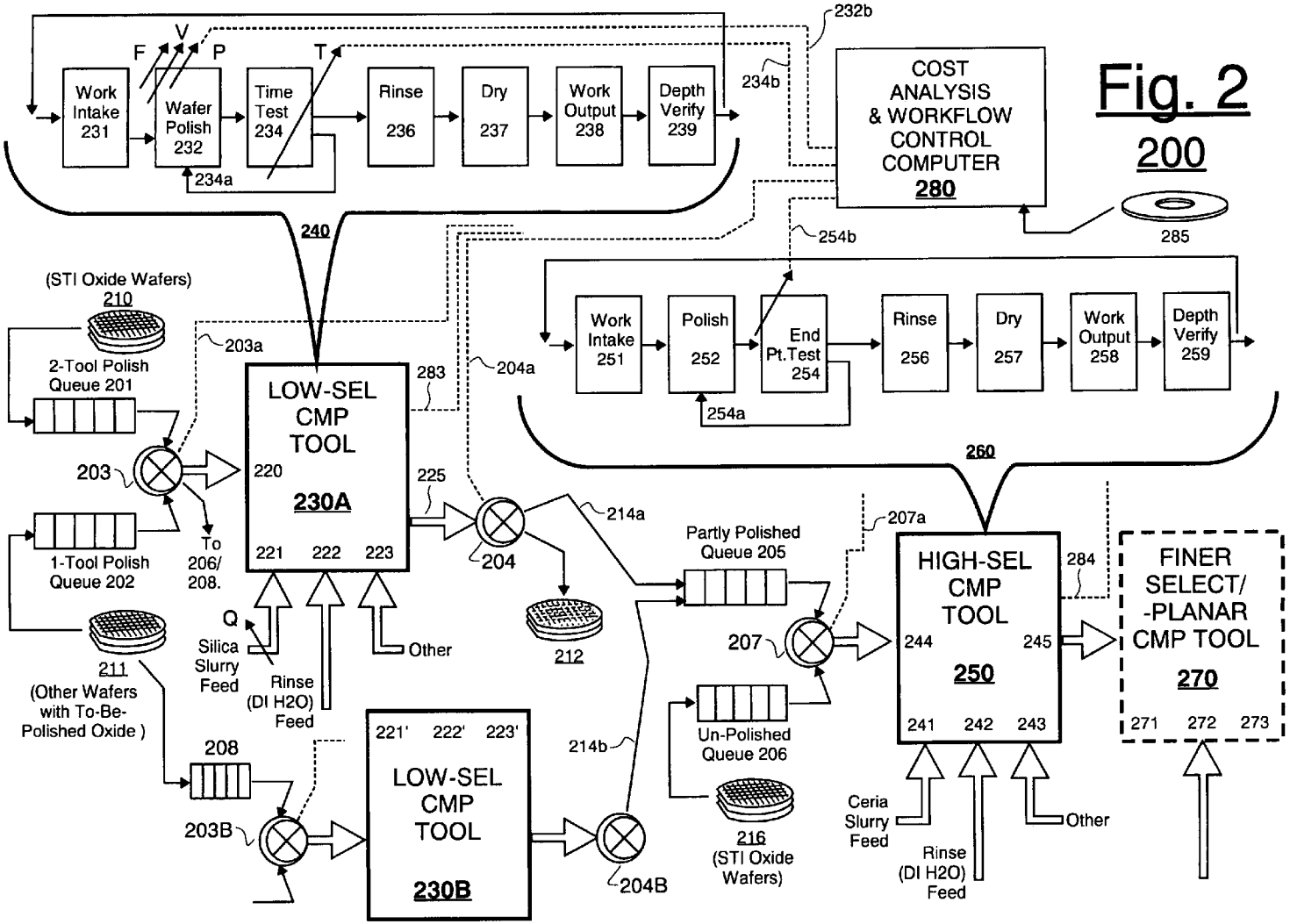
Fig. 2
200
COST ANALYSIS & WORKFLOW CONTROL COMPUTER 280
285
232b
234b
254b
Work Intake 231
Wafer Polish 232
234a
Time Test 234
Rinse 236
Dry 237
Work Output 238
Depth Verify 239
Work Intake 251
Polish 252
End Pt. Test 254
254a
Rinse 256
Dry 257
Work Output 258
Depth Verify 259
240
260
LOW-SEL CMP TOOL 230A
220
221
222
223
283
225
203a
204a
204
Other
Rinse (DI H2O) Feed
Silica Slurry Feed
Q
To 206/ 208.
(STI Oxide Wafers) 210
2-Tool Polish Queue 201
203
1-Tool Polish Queue 202
211 (Other Wafers with To-Be-Polished Oxide )
208
203B
LOW-SEL CMP TOOL 230B
221'
222'
223'
204B
214a
214b
212
Partly Polished Queue 205
207
Un-Polished Queue 206
216 (STI Oxide Wafers)
207a
HIGH-SEL CMP TOOL 250
241
242
243
244
245
284
Ceria Slurry Feed
Rinse (DI H2O) Feed
Other
FINER SELECT/ -PLANAR CMP TOOL 270
271
272
273

MULTI-TOOL, MULTI-SLURRY CHEMICAL MECHANICAL POLISHING

FIELD OF DISCLOSURE

The present disclosure of invention relates generally to Chemical Mechanical Polishing (CMP).

The disclosure relates more specifically to mass production of semiconductor devices and to the economical chemical mechanical polishing of silicon oxide down to a silicon nitride stop in a facility that provides CMP processing for other kinds of semiconductor structures as well.

CROSS REFERENCE TO PATENTS

The disclosures of the following U.S. patents are incorporated herein by reference:

(A) U.S. Pat. No. 6,500,712, issued Dec. 31, 2002 to Kuo-Chun Wu and entitled "Fabrication of dielectric in trenches formed in a semiconductor substrate for a nonvolatile memory".

DESCRIPTION OF RELATED ART

As its name implies, Chemical Mechanical Polishing (CMP) generally uses a combination of mechanical material removal and chemical material removal for polishing the surface of a supplied workpiece to a desired thickness, smoothness, and/or planarity. By way of example, the workpiece can be an oxide-coated semiconductor wafer.

When CMP is carried out, a slurry composed of mechanically-abrasive and/or chemically-reactive particles is typically deposited and continuously fed onto a disk-shaped polishing pad. The pad is often mounted on a rotating platen so that the slurry-coated pad surface moves relative to a supplied workpiece. A to-be-polished surface of the workpiece is brought face-down into pressurized contact with the rotating and slurry-coated, polishing pad so that the slurry can remove a desired amount or kind of surface material from the workpiece and/or smoothen the to-be-polished surface and/or planarize to-be-polished surface. At the end of the polishing process, the workpiece is typically rinsed to remove left over debris and slurry material from its surface. The polishing pad may also be rinsed, reconditioned and/or loaded with fresh new slurry at this time to prepare for the polishing of a next workpiece.

Many variables can affect chemical mechanical polishing, including platen velocity, workpiece pressure, initial workpiece smoothness, slurry composition, and slurry feed rate. Among these, the composition of the CMP slurry plays a particularly important role in determining what kinds of surface materials can be polished and to what degree of smoothness and/or planarity. If the slurry composition contains particles which are too abrasive and/or not homogeneous in size and reactivity, the composition may cause undesirable scratching or other damage to the to-be-polished workpiece. If the slurry is not abrasive and/or reactive enough, it may take an unacceptable amount of time and/or energy to polish down to a desired depth and/or to achieve a desired degree of surface smoothness and/or to achieve a desired degree of planarity.

Silica ($SiO_2$) based abrasive slurries have been conventionally used for polishing oxide-coated semiconductor wafers. However, such silica-based CMP slurries tend to lack selectivity for silicon oxide over other compounds (e.g., silicon nitrides) and they do not inherently drive the polishing process towards a high degree of planarity. As a result, use of silica-based CMP slurries has fallen out of favor for patterned semiconductor wafers whose active devices (e.g., transistors) are to have submicron critical dimensions (e.g., channel lengths of less than 0.18 $\mu$m).

Researchers have begun to favor the use of ceria ($CeO_2$) based abrasive slurries as alternatives to the more traditional silica-based CMP slurries. Ceria-based slurries tend to be highly selective for removal of silicon oxides over other compounds (e.g., silicon nitrides) and their surfactant content is believed to inherently drive the polishing process towards a high degree of planarity. However, ceria-based slurries are not without their set of drawbacks. Ceria-based CMP slurries tend to be more expensive on a per unit volume basis than silica-based CMP slurries. Additionally, ceria-based slurries tend to be slower acting, meaning that it can take much longer to polish silicon oxide down to a desired depth using a ceria-based slurry in place of a silica-based slurry. The ceria-based chemical mechanical polishing mechanism tends to be more chemical in nature and less mechanical than the counterpart, silica-based CMP mechanism. Thus its rate of material removal may be more sensitive to the chemical composition of the material being removed. In some instances (e.g., where the microscopic homogeneity of the material being removed is not tightly controlled), the time for completing ceria-based polishings of a fixed depth can vary widely and unpredictably, this being contrasted by the more predictable timing of silica-based polishing.

The costs of using a ceria-based polishing process therefore tends to be substantially larger than those associated with using silica-based slurries. Part of the extra cost comes from the ceria-based polishing tool being used for a longer period of time to polish away a comparable amount of surface material. More of the extra cost can come from the consumption of larger amounts of consumables during the longer CMP run, including larger amounts of the ceria slurry itself and/or larger amounts of an associated rinse fluid (e.g., De-Ionized water). Moreover, the unpredictability of the longer run times of ceria-based polishing can interfere with smooth scheduling of workflow in a mass production factory. Batches of further work product (e.g., Shallow Trench Isolation {STI} wafers) may back up in respective queues of the mass production line as those further batches wait for the completion of a ceria-based CMP polishing of a first batch of workpieces. The smooth movement of work through a mass production facility (e.g., an integrated circuit fabrication factory) may suffer substantially due to the unpredictably long run time of a given ceria-based polishing operation.

INTRODUCTORY SUMMARY

Structures and methods may be provided in accordance with the present disclosure of invention for improving over the above-described drawbacks of using ceria-based or alike slurries for chemical mechanical polishing.

More specifically, in accordance with one set of aspects of the present disclosure, techniques are provided for allowing one or more of the following:

1) Shorter, per wafer polish time for STI (Shallow Trench Isolation) and/or like workpieces while nonetheless using ceria-based chemical mechanical polishing;
2) More economical polishing of STI and/or like workpieces while nonetheless using ceria-based chemical mechanical polishing; and 3) Flexibility in managing workflow in a mass production facility that employs ceria-based chemical mechanical polishing.

From a broader perspective, it has been realized that as one polishes down (via CMP) through a given thickness of a layer of to-be-removed material (e.g., silicon oxide), it is often not as important at the beginning part of the polishing process to provide for high selectivity and/or for a high degree of planarity. Provision for higher selectivity and/or greater planarity generally becomes more important as one approaches the end portion of the polishing process and as one approaches a targeted depth of polish and/or a new layer of material (e.g., silicon nitride). Accordingly, at the beginning of a given polishing operation, one can use a first CMP slurry (e.g., a silica-based slurry) with a relatively poorer removal selectivity characteristic and/or a relatively poorer propensity for providing planarity, while as the polishing operation approaches completion, one can switch to the use of a second CMP slurry (e.g., a ceria-based slurry) having a comparatively better selectivity for the material being removed (e.g., silicon oxide as opposed to silicon nitride) and/or a better propensity for providing planarity.

It has been further realized that the less-selective, first CMP slurry (e.g., a silica-based slurry) can have greater applicability to a broader range of removable materials (because of its poorer selectivity) while the second CMP slurry (e.g., a ceria-based slurry) can have more restricted, economical applicability to a narrower range of removable materials (because of its greater selectivity). Therefore the different CMP slurries should be provided in separate tools so that the tool with comparatively broader applicability is available on a more economic basis for use by a broader range of workpieces. Workpieces that are to undergo successive polish-down by slurries of successively improved selectivity and/or successively improved planarity should be successively moved from tools of wider applicability to tools of narrower applicability so as to make optimal use of such varied-applicability tools.

A chemical mechanical polishing method in accordance with the disclosure may comprise: (a) supplying a batch of workpieces to a first CMP tool for partly polishing each to-be-polished member of the batch with one or more of a first set of slurries (e.g., silica-based ($SiO_2$-based) CMP slurries), where the first set of slurries are characterized as having a comparatively poorer removal selectivity characteristic and/or a relatively poorer propensity for providing planarity when compared to slurries of a next-recited, second set of slurries; and (b) forwarding the batch of partly-polished workpieces to a second CMP tool which uses one or more of said second set of slurries (e.g., ceria-based ($CeO_2$-based) CMP slurries) to further polish each to-be-polished member of the batch of partly-polished workpieces and/or to complete the polishing of the partly-polished workpieces, where the second set of slurries are characterized as having a comparatively greater removal selectivity characteristic and/or a relatively better propensity for providing planarity when compared to slurries of the first set. Such a CMP method may further include: (a.1) using time measurement to determine when the less-selective CMP operations in the first CMP tool should finish; and (b.1) using end-point detection to determine when the more-selective CMP operations in the second CMP tool should finish.

A mass production facility in accordance with the disclosure may comprise: (a) a plurality of different chemical mechanical polishing tools including a relatively nonselective, first CMP tool which uses silica ($SiO_2$) based abrasive slurries or equivalents to polish supplied batches of workpieces, and a relatively more selective, second CMP tool which uses ceria ($CeO_2$) based abrasive slurries or equivalents to polish supplied batches of workpieces; and (b) a workflow control computer which includes a workflow control program that causes at least one batch of workpieces to flow through the relatively nonselective, first CMP tool and to subsequently flow through the relatively more selective, second CMP tool.

Other aspects of the disclosure will become apparent from the below detailed description.

BRIEF DESCRIPTION OF THE DRAWINGS

The below detailed description section makes reference to the accompanying drawings, in which:

FIG. 2 is a schematic diagram illustrating the operations of mass production facility that is structured in accordance with the present disclosure to use combinations of CMP tools with relatively greater and lesser selectivities.

DETAILED DESCRIPTION

Figure 1:
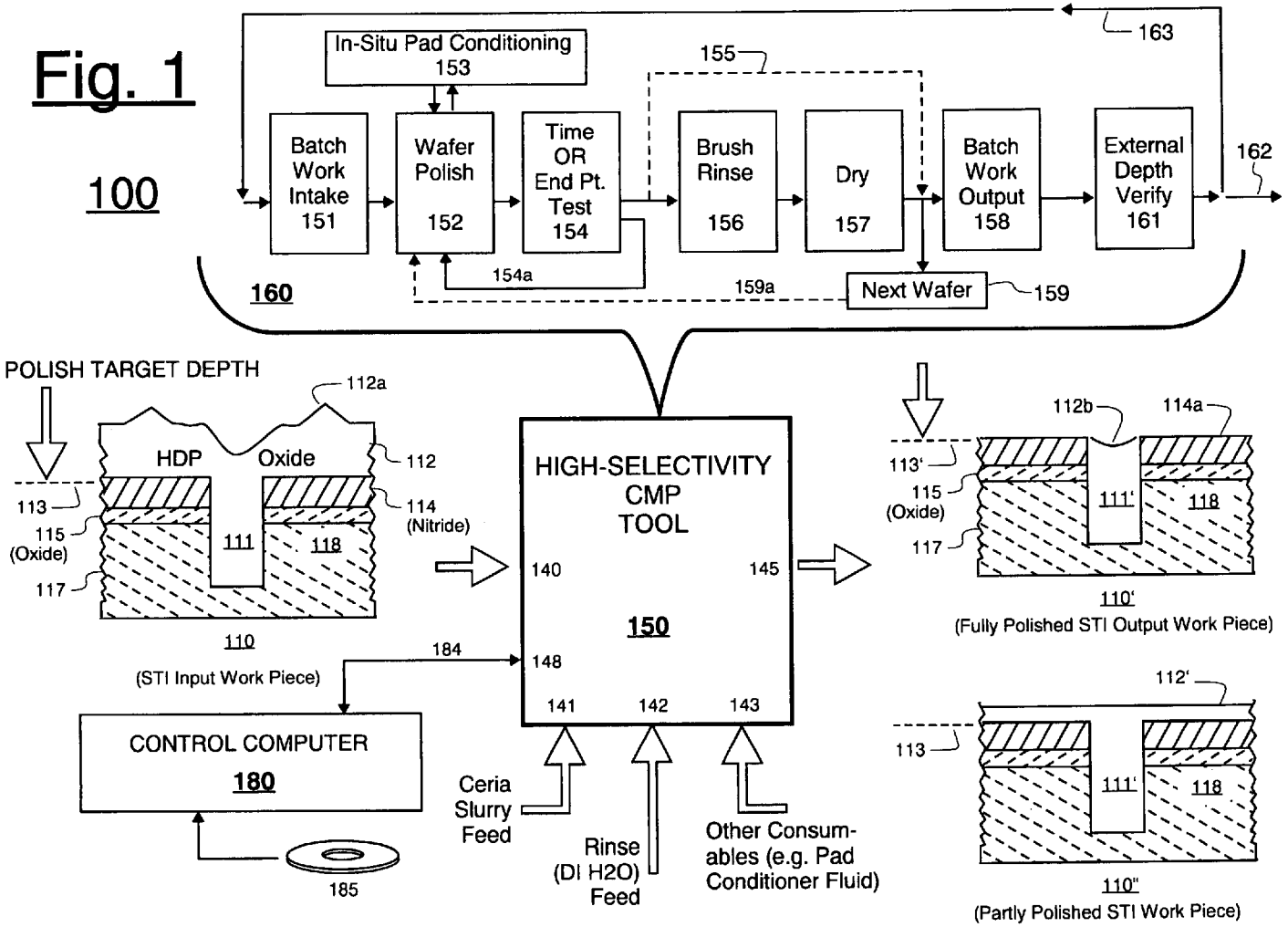
FIG. 1 is a schematic diagram illustrating the operations of a relatively selective, CMP tool which uses ceria ($CeO_2$) based abrasive slurries or equivalents to polish supplied batches of workpieces.

FIG. 1 is a schematic diagram of part of a wafer production system 100 to which the here disclosed invention may be applied. The system 100 includes a high-selectivity CM polishing tool 150 that is configured for selective removal of silicon oxide. A control computer 180 is operatively coupled via a bidirectional link 184 to a signal port 148 of the high-selectivity CMP tool 150 so the computer can send control commands to the tool and receive sensor signals from the tool 150. One or more computer programs 185 may be loaded into the control computer 180 from tangible computer media (e.g., CD-ROM disk) and/or from a communications network in the form of manufactured instructing signals so as to cause the computer 180 to carry out operations described herein.

For purpose of illustrating selective removal of given material layer (e.g., silicon oxide), the polishing of a simply-structured STI workpiece 110 (e.g., a Shallow Trench Isolation semiconductor wafer) will be described. The high-selectivity CMP tool of this example uses a ceria ($CeO_2$) based abrasive slurry to selectively remove a top layer of silicon oxide (112) from supplied wafers and to leave behind a relatively well-planarized surface (113') on the processed wafers. More specifically, a to-be-polished workpiece 110 is shown in cross-section on the left side of FIG. 1 as including a monocrystalline semiconductor substrate 117 (e.g., silicon) which has pad oxide 115 formed on a surface thereof. The oxide-padded surface of the wafer includes an active region 118 which is to be protected from damage because one or more active devices (e.g., transistors) will be later formed in this active region 118. The exemplary STI workpiece 110 has a silicon nitride layer 114 of predefined thickness disposed on the pad oxide layer 115. A shallow isolation trench 111 has been defined in the wafer to extend through the nitride layer 114, through the pad oxide layer 115, and into the substrate 117, adjacent to the active region 118 as shown. High Density Plasma (HDP) oxide 112 has been deposited by CVD or other appropriate means to fill the trench 111 and to cover the nitride layer 114 as shown. For various reasons, including the fact that the shallow trench 111 presents a nonplanar profile as the oxide 112 is deposited, the HDP deposited oxide 112 has a relatively nonplanar top surface 112*a*.

It is desirable to polish away the upper portion of the HDP oxide 112 so as to expose the nitride layer 114 at a planar target level 113 just below the upper surface of the nitride layer 114. To this end, the STI workpiece 110 (left side of FIG. 1) is fed into a transfer port 140 of the high-selectivity CMP tool 150 along with a plurality of alike workpieces (not shown). Typically such an inloaded batch of workpieces will have 10 or more workpieces. A common number is 25 workpieces per batch.

Various kinds of different operations may occur within the high-selectivity CMP tool 150 depending on its specific design. For purposes of illustration, a particular flow of operations is schematically shown at 160. In step 151 a batch of workpieces is transferred into the tool 150 via port 140. At step 152 a next one of successive wafers in the batch is polished. During polishing, in-situ and/or other kinds of pad conditioning 153 may take place. Such pad conditioning may include the use of a diamond-tipped conditioning disk for opening up pores at the top surface of the polishing pad. Then dummy wafers are often used to bring the pad into steady state condition. During the dummy wafer conditioning, ceria slurry is fed continuously into the tool 150 through a slurry input port such as 141. The process then switches to use of patterned wafers (not dummies) and ceria slurry continues to be fed into the tool 150. In step 154 the completion point for the per wafer polishing step is determined either on the basis of measuring polishing time until a predefined time limit is reached or through the use of end-point testing. Various end-point determination techniques may be used including optical detection, temperature detection, force feedback and/or chemical trace analysis of waste slurry. The end-point mechanism 154 supplies a completion signal 154*a* to the wafer polishing step 152 indicating that the current polishing is to stop and that a next wafer is to be polished.

After the polishing of one or more wafers completes, the polished wafer or wafers may be brush-rinsed in step 156 and thereafter spin dried in step 157. The rinse and dry steps typically occur inside tool 150 prior to batch output step 158. Alternatively, polished wafers may be transferred via optional path 155 for batch output at step 158 (after all wafers of the batch had been polished as a result of succession step 159). In this alternate approach 155 the outloaded wafers undergo subsequent brush-rinsing and drying in a separate tool (not shown) before being conveyed to next step 161.

Following the outloading (158) of a batch of polished workpieces (e.g., out of output transfer port 145), one or more sample workpieces from the batch are often taken to a tool-external station 161. Optical and/or other kinds of tests are conducted on the sampled pieces to determine whether the polishing process (152) in tool 150 has successfully reached the targeted depth 113 and has provided a planar finish of desired cross-wafer uniformity and non-roughness. Typically, there will be some overpolishing or erosion of the original nitride layer 114 so that the actual surface 114*a* of the polished workpiece is at a level 113' slightly below the originally targeted level 113. Additionally, there may be some dishing of the in-trench oxide 111' as indicated at 112*b* so that the planarity of the polished surface is not as close to perfection as may be desired. If nitride erosion and/or trench dishing exceed allowed tolerance ranges, then the polished batch may have to be discarded. Parameters of the high-selectivity CMP tool 150 (e.g., polish pressure) may then have to be adjusted to prevent such overpolishing on future batches.

It is also possible for the output batch (145) to be underpolished. Such a condition is shown at 110". As seen, incomplete oxide clearing leaves an overlayer 112" of HDP oxide above the nitride layer 114 and above the targeted polishing level 113. In such a case, path 163 may be followed to return the under-polished batch for a second intake 151 into the polishing tool 150. The under-polished batch will be further polished in tool 150, hopefully down to the desired target level 113 and not too deep beyond. Then the external verification step 161 will be repeated.

If, on the other hand, the external depth verification step 161 indicates that the batch had been polished to within predefined tolerances, then a signal may be sent to the tool 150 to begin an intake 151 of a next batch of workpieces for polishing. At the same time, the successfully polished, first batch may be forwarded via path 162 for further processing (e.g., nitride etch in the case of the illustrated STI wafers).

Experience with different ceria slurries (141) has shown that ceria-based polishing can be slow and that length of polish time may be unpredictable from batch to batch. In some instances, it may take as much as 8 minutes or more per wafer to polish down through approximately 6000 Å of HDP oxide. This ceria-based polishing time can fluctuate randomly over a range of about 3 to 8 minutes for the 6000 Å thick example. Such fluctuation can create workflow scheduling problems. In some mass production facilities the observed per wafer polishing time of 3–28 minutes may be considered unacceptably large. Additionally, the relatively lengthy polishing time has another drawback. Polishing time is typically accompanied by a continuous feeding (141) of expensive ceria slurry into the tool 150 and by the subsequent feeding (142) of rinse fluid (e.g., deionized water). The number of rinses per batch may be made a function of total polish time per batch, meaning that more rinse fluid will be consumed as per batch polish time increases under such a condition. In some instances, other consumables such as new pads and/or separate pad conditioning fluids may be further fed (143) into the tool for consumption during batch processing and/or in between batches and their respective replacement rates may be made a function of per batch polish time. The lengthy polishing time of the ceria-based tool 150 may therefore disadvantageously drive the cost of consumables higher while also reducing the speed of workflow.

In large scale mass-production facilities, it is desirable to reduce the processing time spent by each batch in each of successive tools so that production throughput can be increased. It is also desirable to reduce the amounts of expensive consumables that are consumed per batch. In the case of a high-selectivity tool such as 150, the consumable of prime interest is the ceria-based slurry (any CMP slurry which contains a substantial amount of $CeO_2$ particles for carrying out the chemical mechanical polishing mechanism). To a lesser degree, it may be desirable to reduce the per batch consumption rate of other such consumables such as rinse fluid and/or polishing pads.

FIG. 2 is a schematic diagram of a mass production facility 200 that is structured in accordance with the present disclosure. The facility 200 includes at least a first CMP tool, 230A of relatively low selectivity and/or of relatively poor planarity and at least a second CMP tool, 250 of comparatively higher selectivity and/or of comparatively greater ability to achieve near-perfect planarity. Selectivity refers here to the ability to selectively polish away one material more than another; for example, to preferentially polish away more silicon oxide than silicon nitride when both materials are present at or very near the surface which is undergoing polishing. More specifically, a desired selectivity criteria may call for the removal of at least ten times as much of the selected material (e.g., silicon oxide) than the non-selected material (e.g., silicon nitride) when both are exposed in roughly equal amounts at a surface. Planarity refers here to minimizing deviation from an ideal Euclidean plane within a specified square or other bounded region. There can be many different kinds of measures of planarity. For purposes of shorthand, the first tool 230A will be referred to as the low-selectivity CMP tool and the second tool 250 will be referred to as the high-selectivity CMP tool. It will be understood however that this shorthand allows for the broader definition of the first tool 230A as being one or both of a comparatively low-selectivity tool and a tool that is less-able to achieve near perfect planarity. It will be further understood that this shorthand allows for the broader definition of the second tool 250 as being one or both of a comparatively higher-selectivity removal tool and a tool that is able to achieve more near perfect planarity than can the first tool 230A.

In the case where the material that is to be preferentially-polished away is a silicon oxide (e.g., 112 of FIG. 1) and the material that is to be retained and planarized is a silicon nitride (e.g., 114), the low-selectivity first CMP tool 230A preferably uses a silica-based slurry that is fed into port 221 while the high-selectivity second CMP tool 250 uses a ceria-based slurry that feeds into port 241. At least one group (201) of work product is designated as a multi-tool (e.g., 2-Tool) polish group whose members pass first through the low-selectivity first CMP tool 230A for partial polishing therein to a level above target (e.g., above level 113 of FIG. 1). Then that group's work-in-process (205) continues through the high-selectivity second CMP tool 250 for completion therein of the polishing of the group's wafers. In one embodiment, the workpieces of the 2-tool polish group 201 have approximately 25% to 75%, and more preferably approximately 50% to 66% of the depth of their to-be-polished surface material (e.g., HDP oxide 112 of FIG. 1) removed in the low-selectivity first polishing tool 230A and then the remainder removed in the high-selectivity second CMP tool 250. In one embodiment, it has been found that approximately the first 1,500 Å to 4,000 Å of a 6,000 Å deep HDP oxide layer (112) may be removed at a rate of approximately half a minute per wafer (about 30 s/wafer) in the low-selectivity first tool 230A while the remainder of the HDP oxide layer may be subsequently removed in the high-selectivity second CMP tool 250 with a per wafer polishing time of less than roughly 1 minute (<60 s/wafer). In some cases, polishing time (to finish) in the high-selectivity second CMP tool 250 can be as little as 40 seconds per wafer for the partly polished remainder of the partly-polished HDP oxide layer.

The partly-polished work product of queue 205 may be seen as corresponding to cross section 110" of FIG. 1 with one exception being that the planarity may not be as good as that which might have been obtained with a ceria-based CMP slurry. Another exception is that the presence of the left-over HDP oxide (corresponds to 112') is intentional in the case of the partly-polished work product (205) and that the left-over HDP oxide occurs with relative uniformity across the batches on a wafer-to-wafer basis rather than being accidental and sporadic in a given wafer or a given batch. Another difference is that the depth of the left-over HDP oxide 112' is relatively large, for example, about 30% to 75% of the original HDP thickness in the examples given for the 6,000 Å deep HDP oxide layer (112). By contrast, accidental underpolish may be roughly 1% to 5% of the original HDP thickness and substantially nonhomogeneous across a given wafer's surface.

In one embodiment, the per-wafer polishing step 252 of the high-selectivity second tool 250 ends in response to end-point detection (254) while the per-wafer polishing step 232 of the low-selectivity first tool 230A ends in response to time measurement (234). There is no need for a fixed depth of polishing and/or for a uniform and highly planar end result when a 2-Tool wafer (210) passes through step 232 of the first tool 230A because polishing down to a desired level (113) with a desired amount of nitride exposure and/or a desired amount of cross-wafer planarity and/or a desired amount of cross-wafer smoothness will occur in the second tool 250 (or alternatively in a third CMP tool 270 of yet better selectivity and/or planarity). As a result, the time (T) set for time measurement test 234 and/or the resolution of that time measurement can be varied on-the-fly to accommodate situations developing within the mass production facility 200.

By way of example, assume that queues 205 and 206 (feeding into second tool 250) are empty or only lightly filled. Assume that one or both of queues 201 and 202 (feeding into first tool 230A) are deemed to be filled beyond respective, predefined thresholds. Alternatively, assume that there is some other imperative condition that makes it attractive (economically or otherwise) to quickly empty the low-selectivity first tool 230A of its current, in-process batch so that a new batch can be inloaded (220) quickly into that more general-purpose tool 230A. (Or, alternatively, the imperative is for quickly performing of maintenance on tool 230A.) In such a case, if the current, in-process batch is a 2-Tool group (201), and polishing (232) has not yet begun, the per-wafer polish time (T) for the batch, which time, T is established by test 234, can be reduced as appropriate (even down to zero in theory) so that the current, in-process batch can be more quickly outloaded (225, 238) from the first tool 230A. Depth verification step 239 can be bypassed for the 2-Tool batch because polishing in the second tool (250) will be end-point driven (254) rather than being controlled in an open loop fashion.

Aside from the ability to modulate polish time T for a 2-Tool batch (210), additional flexibility is obtained for modulating any one or more of polish pressure (P), pad velocity (V) and slurry feed rate (F) in view of the understanding that the end goal of the operation in the first tool 230A is not to polish down precisely to a desired final level (113) and/or to provide a desired final quality of cross-wafer planarity and/or a desired final quality of cross-wafer smoothness in the 2-Tool batch (210), but rather to reduce the amount of work and cost required to finish the polishing job in the high-selectivity second CMP tool 250 (or alternatively in the yet finer-resolution CMP tool 270).

Yet another variable that is open for manipulation is the quality (Q) of the silica slurry fed into port 221. Among available silica-based CMP slurries, some may provide better planarity and/or surface smoothness than others. The better performance may be associated with higher per-volume cost for the slurry. In accordance with the present disclosure, it may be possible to reduce operating costs by selectively shifting the quality (Q) of the slurry used to a lower one when polishing a 2-Tool batch (210) instead of a 1-Tool polish batch (211). The reason is that the depth and/or selectivity and/or planarity achieved in the first CMP tool 230A is not the final one for the 2-Tool batch (210) and therefore use of a higher quality (high Q) silica-based CMP slurry for such a 2-Tool batch (210) will constitute overkill if a lower quality and/or less costly and/or more plentiful slurry will do.

As already explained, the partly-polished work product of queue 205 may be viewed as corresponding somewhat to cross section 110" of FIG. 1. The end-point testing step 254 in the second CMP tool will be trying to detect when the left-over HDP oxide 112" has been fully and selectively removed so as to expose the underlying nitride layer 114. A variety of different end-point tests may be carried out in step 254 including those based on optical sensing and those based on sensing change in polishing friction as the last of the HDP oxide 112" is removed and the nitride layer 114 becomes exposed. Typically these end-point tests (254) rely on detection of progress along an earlier-characterized behavior pattern. For example, polishing friction may first rise and then fall dramatically as the nitride layer 114 becomes exposed. When partly-polished work product (205) is supplied as the intake (251) for tool 250 instead of not-yet-polished work product (206), the end-point characterization pattern tends to be different because the starting conditions are different. Therefore, it may be advisable to make some compensating adjustment 254*b* to the end point detecting test(s) 254 in response to detection that the work intake 251 is that from a queue which holds intentionally partly-polished batches (205) as opposed to a queue which holds not-yet-polished batches (206).

In order to manage the complex number of permutations possible within facility 200, an automated work-routing and work-controlling subsystem may be provided within the facility for controlling the flow of work product through the low-selectivity first CMP tool 230A and through the high-selectivity second CMP tool 250. Such a work-controlling subsystem is shown in FIG. 2 as including a unified, cost-analyzing and workflow controlling computer 280. A distributed and network interconnected system of cost-analyzing computers and workflow controlling computers may be used instead. Computer 280 is shown by way of example. Symbol 285 represents a set of manufactured, machine instructing signals which may be loaded into the computer 280 or its equivalent from tangible media and/or from a communications network and may be used for causing the computer 280 or its equivalent to carry out one or more of the automated operations described herein or their equivalents.

Each of the illustrated low-selectivity first CMP and high-selectivity second CMP tools (230A, 230B, 250, etc.) is capable of being used as a separate tool for completing a given material removal job. Therefore, besides the work batches (e.g., 210) that are scheduled for 2-Tool polishing, other work batches (e.g., 211, 216) within the illustrated facility 200 can be scheduled for 1-Tool polishing in appropriate ones of the first and second CMP tools. These options provide the facility 200 with substantial flexibility in managing work product flow. More specifically, when the high-selectivity second CMP tool 250 is not available for polishing due to maintenance downtime or need for repair, the low-selectivity first CMP tool 230A can nonetheless continue to be used for polishing batches of wafers 211 that are scheduled for a single polish down to target depth by way of silica-based polishing. The same low-selectivity first CMP tool 230A can also be used for partly polishing STI oxide wafer batches 201 or the like that will be temporarily stored in queue 205 and will be afterwards further polished in the high-selectivity second CMP tool 250 after that finer-resolution tool 250 is brought back on line.

As seen, the illustrated facility 200 may have multiple queues for storing batches of in-process work as the batches wait for intake into one tool or another. Queue 201 may therefore temporarily hold batches of STI oxide wafers 210, where the queued STI oxide wafers 210 are scheduled for multi-tool polishing down to a target surface (e.g., nitride surface 114*a* of FIG. 1). Queue 202 may hold batches of wafers 211 which can be polished down to target within a single low-selectivity tool (e.g., 230A or 230B). Queue 206 may temporarily hold batches of unpolished STI oxide wafers 216 or the like, where the queued wafers 216 are scheduled for one-tool polishing down to a target level. Queue 205 may temporarily hold batches of partly-polished STI oxide wafers (214*a*, 214*b*) or the like, where the queued and partly-polished wafers may have been partly-polished in different, low-selectivity polishers (230A, 230B).

Low-selectivity CMP tools such as 230A and 230B tend be less expensive and/or more pervasive than higher-selectivity CMP tools such as 250. A given factory will therefore tend to have a larger number of the low-selectivity CMP tools (230A, 230B, etc.) for carrying out general purpose polishing. The given factory will tend to have a comparatively smaller number of high-selectivity CMP tools (250) for carrying more special-purpose polishing such as selectively removing silicon oxide above a silicon nitride layer and/or achieving a high degree of planarity. It is desirable to make efficient and economical use of all the available tools and to smooth out work load among the polishers so that no one of them becomes a major bottleneck to the mass production flows. In accordance with the disclosure, automated work flow routers, such as the one schematically shown at 203, may be used for routing batches of workpieces from either one of queues 201 (the 2-tool queue) and 202 (the 1-tool queue) into the work intake port 220 of a corresponding CMP tool (e.g., 230A) so as to help coordinate a smooth flow of work between the low-selectivity general-purpose polishers and the high-selectivity, special-purpose polishers. In some situations it might not be economical to allow a high-selectivity polisher such as 250 to sit by idlely while a low-selectivity tool such as 230A is finishing a batch of 2-Tool wafers. A computer algorithm may be included in program set 285 for inhibiting the partly-polished queue 205 from becoming empty. On the other hand, it may be similarly uneconomical to let a low-selectivity polisher such as 230A sit by in an idle mode while a high-selectivity tool such as 250 is working its way through a near-full queue 205 of partly-polished workpieces. A computer algorithm may therefore be included in program set 285 for encouraging router 203 to send mostly 1-Tool workflow (e.g., from queue 202) to the low-selectivity polisher 230A in response to a detection that the partly-polished queue 205 is in a near full state. Yet another computer algorithm may be included in program set 285 for encouraging router 203 to send workflow into alternate queues such as 208 and/or 206 in response to a detection that one or both of queues 201 and 202 are near full. Threshold values for the near full condition may be predefined as appropriate for each of the queues and surrounding factory conditions. Wafers 212 represent a batched group that has been polished-down to target in a 1-Tool operation.

The control signals 203*a* for the first workflow router 203 may come from the cost analysis and workflow control computer 280 either in the form of a direct control signal or as a machine-to-human signal that indicates to a human operator which batch is to be next input into port 220 of the corresponding polishing tool 230A. In addition to selecting the destination for either the first queue 201 or the second queue 202 into the work intake port of tool 230A, the automated workflow router 203 may alternatively route workpiece batches to other queues such as 206 or 208 in situations where the low-selectivity first CMP tool 230A is busy or is out-of-commission. Queue 208 feeds into a second low-selectivity CMP tool 230B as shown in the figure. Note that queue 206 feeds unpolished STI wafers through the workflow router 207 of the high-selectivity CMP tool 250. Although it is preferable to polish STI oxide wafers in two steps, first through the low-selectivity CMP tool 230A and then through the high-selectivity CMP tool 250, that does not eliminate the option of completely polishing STI oxide wafers down to target entirely within the high-selectivity CMP tool 250. The cost analysis and workflow controlling computer 280 may make real time and/or on-the-fly determinations of when it is cost-wise prudent to route unpolished STI wafers directly into queue 206 rather than processing such wafers through a combination of both low and high-selectivity CMP tools.

It should be apparent from FIG. 2 that dashed link 204*a* carries router control signals from computer 280 to router 204. Link 207*a* carries router control signals from computer 280 to router 207. The same link 207*a* may further carry queue-fill indicating signals from queues such as 205 and 206 back to the computer 280. Dashed link 283 represents the control and sensing coupling between the computer 280 and the low-selectivity CMP tool 230A. Link 283 may carry control signals such as signal 234*b* for controlling the polish time (T) setting of step 234 and 232*b* for controlling one or more of the polishing pressure (P), pad velocity (V) and slurry feed rate (F) of step 232. Link 283 may further carry control signals for regulating the slurry quality (Q) being fed into port 221 of the low-selectivity CMP tool 230A. Similarly, dashed link 284 represents the control and sensing coupling between the computer 280 and the high-selectivity CMP tool 250. Link 284 may carry control signals such as signal 254*b* for controlling the end-point testing step 254 so it matches with the type of polish work being taken in at step 251. As already explained different end-point characterizing patterns may be associated with respective ones of the partly-polished (205) and unpolished (206) inputs. Additionally, computer 280 may automatically detect and respond to an indication that a multi-tool batch 201 is entering the low-selectivity first CMP tool 230A by modifying one or more of the settings of the polishing pressure (P), pad velocity (V), slurry feed rate (F), and slurry quality (Q) of the first CMP tool 230A so as to provide for faster and/or less planar and/or less precise and/or less costly polishing than would otherwise be normally used in the first CMP tool 230A for full polishing away of the upper material layer (e.g., 112) of each wafer given that the polishing for the multi-tool batch 201 will only be part way in the first CMP tool 230A and that the polishing down to a target level and/or the polishing to achieve a higher degree of planarity will be continued in a subsequent one or more CMP tools such as the high-selectivity second CMP tool 250 and/or the yet finer-resolution, third CMP tool 270.

The present disclosure is to be taken as illustrative rather than as limiting the scope, nature, or spirit of the subject matter claimed below. Numerous modifications and variations will become apparent to those skilled in the art after studying the disclosure, including use of equivalent functional and/or structural substitutes for elements described herein, use of equivalent functional couplings for couplings described herein, and/or use of equivalent functional steps for steps described herein. Such insubstantial variations are to be considered within the scope of what is contemplated here. Moreover, if plural examples are given for specific means, or steps, and extrapolation between and/or beyond such given examples is obvious in view of the present disclosure, then the disclosure is to be deemed as effectively disclosing and thus covering at least such extrapolations.

As an example of possible extensions and/or variations, it is to be understood that embedded computer and communications means may be distributed into tools 230A, 230B, 250 rather than being provided as an external and separate computer means 280. All or appropriate parts of the associated workflow routers (203, 207) and corresponding queues (e.g., 201, 202) may be integrated into the respective low and high-selectivity CMP tools. A computer-readable medium (e.g., 285) or another form of a software product or machine-instructing means (including but not limited to, a hard disk, a compact disk, a flash memory stick, a downloading of manufactured instructing signals over a network and/or like software products) may be used for instructing an instructable machine (e.g., 280) to carry out the activities described herein, where the activities can include the selective routing of single-tool and multi-tool polish work to respective ones of low and high-selectivity polishing tools.

Reservation of Extra-Patent Rights, Resolution of Conflicts, and Interpretation of Terms After this disclosure is lawfully published, the owner of the present patent application has no objection to the reproduction by others of textual and graphic materials contained herein provided such reproduction is for the limited purpose of understanding the present disclosure of invention and of thereby promoting the useful arts and sciences. The owner does not however disclaim any other rights that may be lawfully associated with the disclosed materials, including but not limited to, copyrights in any computer program listings or art works or other works provided herein, and to trademark or trade dress rights that may be associated with coined terms or art works provided herein and to other otherwise-protectable subject matter included herein or otherwise derivable herefrom.

If any disclosures are incorporated herein by reference and such incorporated disclosures conflict in part or whole with the present disclosure, then to the extent of conflict, and/or broader disclosure, and/or broader definition of terms, the present disclosure controls. If such incorporated disclosures conflict in part or whole with one another, then to the extent of conflict, the later-dated disclosure controls.

Unless expressly stated otherwise herein, ordinary terms have their corresponding ordinary meanings within the respective contexts of their presentations, and ordinary terms of art have their corresponding regular meanings within the relevant technical arts and within the respective contexts of their presentations herein.

Given the above disclosure of general concepts and specific embodiments, the scope of protection sought is to be defined by the claims appended hereto. The issued claims are not to be taken as limiting Applicant's right to claim disclosed, but not yet literally claimed subject matter by way of one or more further applications including those filed pursuant to 35 U.S.C. § 120 and/or 35 U.S.C. §251.

What is claimed is:

1. A polishing method comprising:

(a) supplying a first batch of workpieces to a first CMP tool for partly polishing the first batch with one or more silica ($SiO_2$) based chemical mechanical polishing slurries or equivalents;

(b) forwarding the partly-polished first batch of workpieces to a second CMP tool which uses ceria ($CeO_2$)

based chemical mechanical polishing slurries or equivalents to further polish the batch of partly-polished workpieces;

(c) completing the polishing of the partly-polished workpieces in the second CMP tool so as to expose in each workpiece, a predefined and detectable surface level; and (d) using end-point detection in the second CMP tool to determine when the predefined surface level of a given workpiece has been exposed.

2. The polishing method of claim 1 wherein said end-point detection includes at least one of optical detection, force feedback detection, temperature detection, and chemical composition detection.

3. A polishing method comprising:

(a) supplying a first batch of workpieces to a first CMP tool for partly polishing the first batch with one or more silica ($SiO_2$) based chemical mechanical polishing slurries or equivalents;

(b) forwarding the partly-polished first batch of workpieces to a second CMP tool which uses ceria ($CeO_2$) based chemical mechanical polishing slurries or equivalents to further polish the batch of partly-polished workpieces;

(c) completing the polishing of the partly-polished workpieces in the second CMP tool so as to expose in each workpiece, a predefined and detectable surface level;

(d) using end-point detection in the second CMP tool to determine when the predefined surface level of a given workpiece has been exposed; and (e) using time measurement in the first CMP tool to determine when said partial polishing of each workpiece in the first batch should end.

4. The polishing method of claim 3 and further comprising:

(f) shortening a time limit for said time measurement step in response to an indication that imminent use the first CMP tool is being requested for another batch of workpieces.

5. A polishing method comprising:

(a) supplying a first batch of workpieces to a first CMP tool for partly polishing the first batch with one or more silica ($SiO_2$) based chemical mechanical polishing slurries or equivalents;

(b) forwarding the partly-polished first batch of workpieces to a second CMP tool which uses ceria ($CeO_2$) based chemical mechanical polishing slurries or equivalents to further polish the batch of partly-polished workpieces;

(c) completing the polishing of the partly-polished workpieces in the second CMP tool so as to expose in each workpiece, a predefined and detectable surface level;

(d) using end-point detection in the second CMP tool to determine when the predefined surface level of a given workpiece has been exposed; and (e) automatically adjusting polishing pressure in said first CMP tool in response to an indication that workpieces in said supplied first batch are to be only partly-polished.

6. A polishing method comprising:

(a) supplying a first batch of workpieces to a first CMP tool for partly polishing the first batch with one or more silica ($SiO_2$) based chemical mechanical polishing slurries or equivalents;

(b) forwarding the partly-polished first batch of workpieces to a second CMP tool which uses ceria ($CeO_2$) based chemical mechanical polishing slurries or equivalents to further polish the batch of partly-polished workpieces;

(c) completing the polishing of the partly-polished workpieces in the second CMP tool so as to expose in each workpiece, a predefined and detectable surface level;

(d) using end-point detection in the second CMP tool to determine when the predefined surface level of a given workpiece has been exposed; and (e) automatically adjusting velocity of a polishing pad in said first CMP tool in response to an indication that workpieces in said supplied first batch are to be only partly-polished.

7. A polishing method comprising:

(a) supplying a first batch of workpieces to a first CMP tool for partly polishing the first batch with one or more silica ($SiO_2$) based chemical mechanical polishing slurries or equivalents;

(b) forwarding the partly-polished first batch of workpieces to a second CMP tool which uses ceria ($CeO_2$) based chemical mechanical polishing slurries or equivalents to further polish the batch of partly-polished workpieces;

(c) completing the polishing of the partly-polished workpieces in the second CMP tool so as to expose in each workpiece, a predefined and detectable surface level;

(d) using end-point detection in the second CMP tool to determine when the predefined surface level of a given workpiece has been exposed; and (e) automatically adjusting feed rate of a slurry used by said first CMP tool in response to an indication that workpieces in said supplied first batch are to be only partly-polished.

8. A polishing method comprising:

(a) supplying a first batch of workpieces to a first CMP tool for partly polishing the first batch with one or more silica ($SiO_2$) based chemical mechanical polishing slurries or equivalents;

(b) forwarding the partly-polished first batch of workpieces to a second CMP tool which uses ceria ($CeO_2$) based chemical mechanical polishing slurries or equivalents to further polish the batch of partly-polished workpieces;

(c) completing the polishing of the partly-polished workpieces in the second CMP tool so as to expose in each workpiece, a predefined and detectable surface level;

(d) using end-point detection in the second CMP tool to determine when the predefined surface level of a given workpiece has been exposed; and (e) automatically changing between use in said first CMP tool of a first slurry of respective first quality and a second slurry of respective second and different quality in response to an indication that workpieces in said supplied first batch are to be only partly-polished.

9. A polishing method comprising:

(a) supplying a first batch of workpieces to a first CMP tool for partly polishing the first batch with a corresponding one or more of first chemical mechanical polishing slurries, where the supplied workpieces of the first batch each include at least first and second different materials, and where the first CMP slurries are characterized by one or both of:

(a.1) relatively low-selectivity for removal of the first of said at least first and second different materials relative to removal of the second of said materials; and (a.2) relatively poor ability to inherently drive the polishing process towards a high degree of planarity; and (b) forwarding the partly-polished first batch of workpieces to a second CMP tool which uses a corresponding one or more of second chemical mechanical polishing slurries, where the second CMP slurries are characterized by one or both of:

(b.1) relatively high-selectivity for removal of the first of said at least first and second different materials relative to removal of the second of said materials, the high-selectivity being greater than said low-selectivity; and (b.2) relatively good ability to inherently drive the polishing process towards a high degree of planarity, the good ability being better than said relatively poor ability.

10. The polishing method of claim 9 wherein said second chemical mechanical polishing slurries comprise ceria-based CMP slurries.

11. The polishing method of claim 9 wherein said first chemical mechanical polishing slurries comprise silica-based CMP slurries.

12. A polishing method comprising:

(a) supplying a first batch of workpieces to a first CMP tool for partly polishing the first batch with a corresponding one or more of first chemical mechanical polishing slurries;

(b) forwarding the partly-polished first batch of workpieces to a second CMP tool which uses a corresponding one or more of second chemical mechanical polishing slurries, different from the first chemical mechanical polishing slurries;

(c) using a time-based stopping algorithm in the first CMP tool to determine when to stop polishing each workpiece in the first CMP tool so as to achieve partial polishing; and (d) using an end-point detection algorithm in the second CMP tool to determine when to stop polishing each workpiece in the second CMP tool so as to achieve further polishing of each workpiece in the second CMP tool beyond said partial polishing.

13. The polishing method of claim 12 and further comprising:

(e) shortening a time limit for said time-based stopping algorithm in response to an indication that imminent use of the first CMP tool is being requested for another batch of workpieces.

14. The polishing method of claim 9 wherein all of said characteristics (a.1), (a.2), (b.1) and (b.2) are present.

* * * * *